US005295361A

United States Patent [19]

Novak et al.

[11] Patent Number: 5,295,361

[45] Date of Patent: Mar. 22, 1994

[54] DEFROST RECYCLE DEVICE

[75] Inventors: Robert M. Novak, Manitowoc; Gary D. Fredell, Two Rivers, both of Wis.

[73] Assignee: Paragon Electric Company, Inc., Two Rivers, Wis.

[21] Appl. No.: 45,048

[22] Filed: Apr. 8, 1993

[51] Int. Cl.[5] ..... F25B 47/02

[52] U.S. Cl. ..... 62/128; 62/155; 62/156

[58] Field of Search ..... 62/128, 125, 126, 80, 62/129, 130, 151, 152, 153, 154, 155, 156, 234, 140

[56] References Cited

U.S. PATENT DOCUMENTS

| | | | |
|---|---|---|---|
| 4,251,988 | 2/1981 | Allard et al. | 62/80 |
| 4,346,564 | 8/1982 | Gemma et al. | 62/140 |
| 4,528,821 | 7/1985 | Tershak et al. | 62/153 |
| 4,535,599 | 8/1985 | Besson et al. | 62/154 |
| 4,538,420 | 9/1985 | Nelson | 62/140 |
| 4,665,710 | 5/1987 | Kyzer et al. | 62/155 X |
| 4,850,204 | 7/1989 | Bos et al. | 62/234 |
| 4,884,414 | 12/1989 | Bos | 62/156 |
| 4,993,233 | 2/1991 | Borton et al. | 62/155 |
| 5,038,575 | 8/1991 | Yamada | 62/128 X |
| 5,046,324 | 9/1991 | Otoh et al. | 62/156 X |

*Primary Examiner*—Harry B. Tanner
*Attorney, Agent, or Firm*—Foley & Lardner

[57] ABSTRACT

A defrost recycle apparatus and method for use with a temperature control system is provided. The temperature control system includes a heat transfer unit for removing heat from an enclosed space. The temperature control system automatically defrosts the heat transfer unit based upon a default defrost control strategy. After the termination of a defrost operation initiated according to the default defrost control strategy, the defrost recycle apparatus determines if the defrost operation was successful (completely defrosted the heat transfer unit) based upon two parameters associated with the defrost operation. In the preferred embodiment, the defrost recycle apparatus determines the success of the defrost operation based upon the temperature in the vicinity of the heat transfer unit after a predetermined period of time has elapsed after the termination of the defrost operation. If the defrost recycle operation determines that the defrost operation was not successful, the defrost recycle apparatus sends a force defrost signal to the temperature control system to initiate a recycle defrost operation.

38 Claims, 4 Drawing Sheets

DEFROST RECYCLE DEVICE

FIELD OF THE INVENTION

The present invention is generally directed to an apparatus and method for detecting a premature termination of a defrost operation, and more particularly to an apparatus and method for initiating a subsequent defrost operation when a previous defrost operation is determined to have ended prematurely.

BACKGROUND OF THE INVENTION

Temperature control systems generally include a heat transfer unit, such as an evaporator coil or heat pump, disposed to affect the temperature of air within an enclosed space. When a certain amount of frost accumulates on such heat transfer units, the heat transfer characteristics of the heat transfer unit change dramatically, causing a significant decline in the efficiency of the temperature control system.

Consequently, temperature control systems have been developed which automatically defrost their heat transfer units after a period of frost accumulation. The numerous automatic defrosting temperature control systems that have been developed have implemented various strategies to determine when a defrost operation should be initiated. The accuracy of these strategies has a significant effect on the overall efficiency of the temperature control system because, for any given heat transfer unit, the heat transfer characteristics of the heat transfer unit alter abruptly and appreciably after a specific amount of frost has accumulated on the heat transfer unit. The specific amount of frost accumulation which will cause this abrupt decline in efficiency is typically known to the manufacturer of the heat transfer unit.

Attempts have been made to design temperature control systems which automatically defrost their heat transfer units before frost accumulates beyond this known limit in order to achieve optimum efficiency. However, optimum efficiency cannot be realized if the heat transfer unit is defrosted too frequently.

U.S. Pat. No. 4,251,988 issued to Allard et. al. on Feb. 24, 1981 discloses one such temperature control system designed to initiate defrost operations just prior to the accumulation of the critical amount of frost. The Allard temperature control system initiates a defrost operation based upon the duration of a previous defrost operation. Specifically, the time required to defrost the heat transfer unit when the heat transfer unit contains the critical limit of frost accumulation is determined. Then, during operation, the temperature control system monitors the actual time required to defrost the heat transfer unit. If the actual time to defrost the heat transfer unit is greater than the time it would have taken to defrost the unit after a frost build operation of optimal duration, then too much frost was allowed to accumulate during the previous frost build operation (i.e., the defrost operation was initiated too late). On the other hand, if the actual time to defrost the heat transfer unit is less than the time it would have taken to defrost the heat transfer unit after a frost accumulation of optimal duration, then the previous frost build operation was too short (i.e., the defrost operation was initiated too soon). Based on this information, the time allowed for the current frost build operation is adjusted to be longer than the previous frost build operation if the previous defrost operation took less time than it should have, or to be shorter than the previous frost build operation if the previous defrost operation took more time than it should have.

Because the Allard defrosting strategy hinges on the duration of the actual time it takes to defrost a heat transfer unit, it is critical to accurately ascertain when the heat transfer unit is completely defrosted. If the defrost operation terminates prematurely (i.e., before the heat transfer unit is completely defrosted), then the duration of the defrost operation will not accurately reflect the time required to actually defrost the heat transfer unit. Consequently, any adjustments to the frost build time based on the duration of the defrost operation will be inaccurate.

The Allard temperature control system employs a conventional defrost thermostat (element 11) to indicate that the heat transfer unit is free of frost, and consequently to terminate the defrost operation. The defrost thermostat is placed in the vicinity of the heat transfer unit and configured to open its contacts when a predetermined defrosting temperature is exceeded. Thus, since the duration of frost build operations is determined based upon the duration of defrost operations, and the duration of defrost operations is determined by the operation of a defrost thermostat, the efficiency of the entire Allard temperature control system hinges on the accuracy of the defrost thermostat to indicate when the heat transfer unit is completely defrosted.

Based upon the foregoing, it is clearly desirable to provide an apparatus and method for checking the accuracy of a defrost completion indicator, such as a thermostat. It is further desirable to provide an apparatus and method for determining if a previous defrost operation terminated prematurely. It is further desirable to provide an apparatus and method for initiating a subsequent defrost operation if it is determined that a previous defrost operation terminated prematurely. Finally, it is clearly desirable to provide an apparatus and method for use with a temperature control system for initiating a second defrost operation if, after a first defrost operation, the heat transfer unit is not completely defrosted.

SUMMARY OF THE INVENTION

According to one aspect of the present invention, an apparatus for use with a defrost control device for indicating an occurrence of a premature termination of a defrost operation is provided. The defrost control device generates a termination indication when the defrost operation terminates. The apparatus generally includes a sensing means operatively connected with the defrost control device for sensing the termination indication, a first measuring means for measuring one of a first or a second parameter associated with the defrost operation as a first measured parameter, and a second measuring means for measuring the other of the first or second parameters associated with the defrost operation as a second measured parameter.

The first measuring means, the second measuring means, and the sensing means are operatively connected, and the second measuring means generates a measured second parameter value indicating the second measured parameter as measured substantially when the first measured parameter substantially equals a first predetermined value.

The apparatus further includes a comparing means operatively connected with the second measuring means for comparing the measured second parameter value with a second predetermined value, and a signal generating means operatively connected with the comparing means for generating a premature termination signal when the measured second parameter value has a particular relationship with the second predetermined value.

According to another aspect of the present invention, an apparatus for use with a temperature control device configured to control temperature within an enclosed space is provided. The apparatus indicates an occurrence of a premature termination of a defrost operation, and includes a sensing means operatively connected with the temperature control device for sensing a termination indication generated by the temperature control device when the defrost operation terminates.

The apparatus further includes a monitoring means operatively connected with the sensing means for monitoring a parameter associated with a condition within the enclosed space as a first measured parameter, and for monitoring elapsed time from the termination indication as a second measured parameter, and a first comparing means operatively connected with the monitoring means for comparing a selected parameter of the first measured parameter or the second measured parameter with a first predetermined value. The apparatus further includes a second comparing means operatively connected with the first comparing means and the monitoring means, for comparing the other parameter of the first measured parameter or the second measured parameter than the selected parameter with a second predetermined value when the selected parameter substantially equals the first predetermined value. Finally, the apparatus includes a signal generating means operatively connected with the second comparing means for generating a premature termination signal when the other parameter has a particular relationship with the second predetermined value.

Further advantages and features of the present invention will be apparent from the following specification and claims when considered in connection with the accompanying drawings illustrating the preferred embodiments of the invention.

BRIEF DESCRIPTION OF THE DRAWINGS

The features of the present invention, which are believed to be novel, are set forth with particularity in the appended claims. The invention, together with further objects and advantages thereof, may best be understood by making reference to the following description taken in conjunction with the accompanying drawings, in the several figures of which like reference numerals identify like elements and wherein:

DETAILED DESCRIPTION

Figure 1:
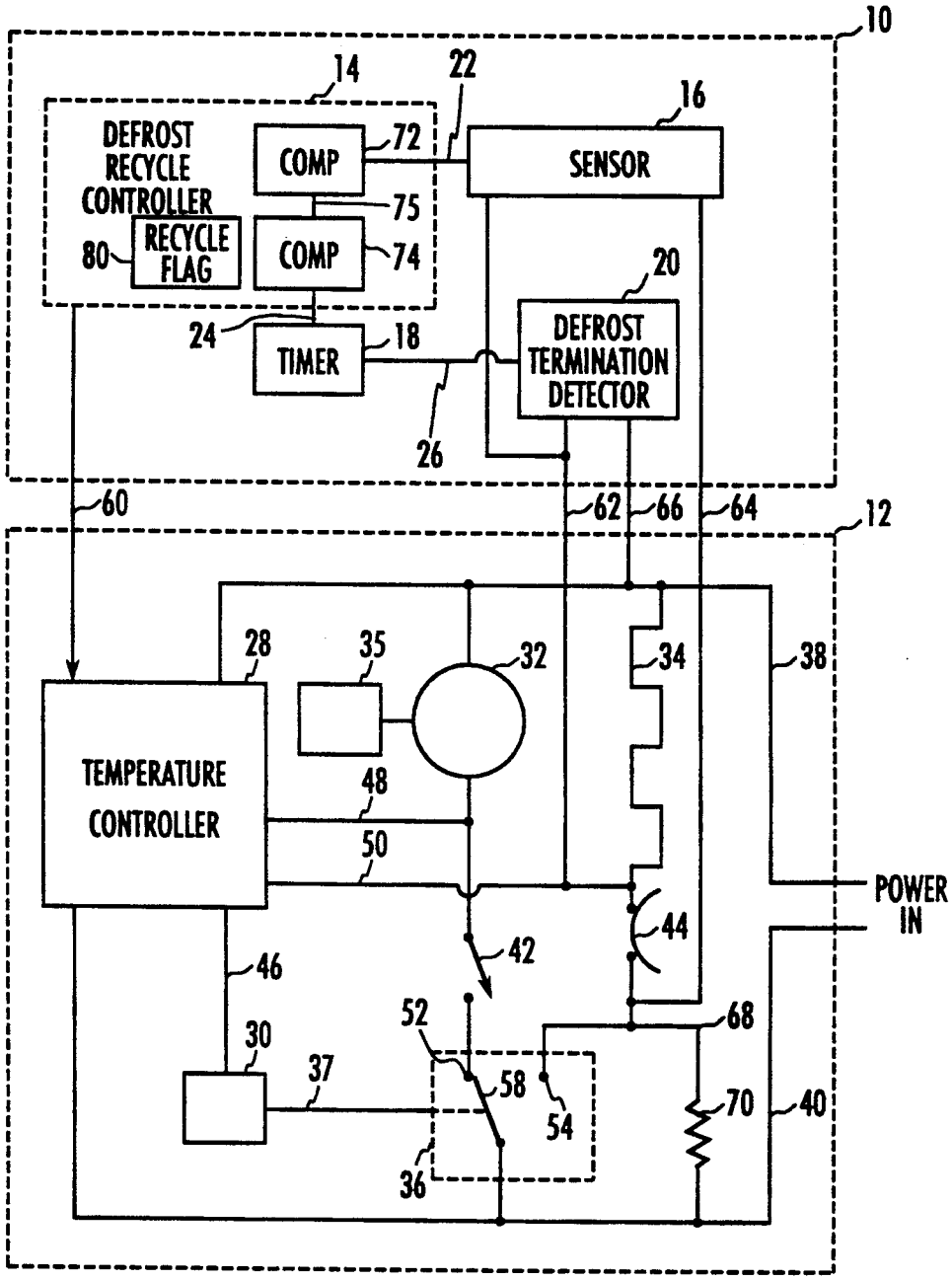
FIG. 1 is a block diagram illustrating a defrost recycle apparatus, according to the presently preferred embodiment of the invention, operatively connected with a temperature control system.

FIG. 1 is a block diagram illustrating a defrost recycle apparatus 10, according to the presently preferred embodiment of the invention, operatively connected with a temperature control system 12. In FIG. 1, temperature control system 12 is similar to the temperature control system disclosed in Allard but may alternatively be any temperature control system. Temperature control system 12 generally includes a temperature controller 28, a driver 30, a compressor 32, a defrost heater 34, and a defrost control switch 36. Power is supplied to the components of temperature control system 12 through a plurality of power lines 38, 40.

Defrost control switch 36 is connected to driver 30 by a control line 37 and includes a control arm 58 connected to power line 40. Control arm 58 connects power line 40 with a frost build contact 52 or a defrost contact 54 in response to signals from driver 30 over line 37.

Compressor 32 controls a heat transfer unit 35 and is connected to power line 38 directly. Compressor 32 is connected to power line 40 through a thermostat 42 and defrost control switch 36. Thus, compressor 32 is energized when thermostat 42 is closed and arm 58 of defrost control switch 36 contacts frost build contact 52. When compressor 32 is energized, heat is removed from the enclosed space controlled by temperature control system 12 by heat transfer unit 35, and frost begins to accumulate on heat transfer unit 35. These conditions constitute a frost build operation.

Defrost heater 34 is connected to power line 38 directly. Defrost heater 34 is connected to power line 40 through a bi-metal switch 44 and defrost control switch 36. Thus, when bi-metal switch 44 is closed and control arm 58 contacts defrost contact 54, defrost heater 34 is energized. When defrost heater 34 is energized, the air in the vicinity of heat transfer unit 35 is heated, causing any frost which has accumulated on heat transfer unit 35 to melt. These conditions constitute a defrost operation.

Driver 30 controls the position of control arm 58 of the defrost control switch 36 via line 37. Driver 30 may be, for example, a solenoid coil, and is analogous to the solenoid coil (element 26) of the Allard system.

Bi-metal switch 44 is configured to close when the air in the vicinity of heat transfer unit 35 falls below a predetermined temperature, and to open when the air in the vicinity of heat transfer unit 35 exceeds a predetermined temperature. The predetermined temperature or "opening temperature", at which bi-metal switch 44 opens, is the temperature selected to indicate that heat transfer unit 35 is completely defrosted. Thus, bi-metal switch 44 is analogous to the defrost thermostat (element 11) of the Allard defrost control system.

Temperature controller 28 controls driver 30 by signals sent to driver 30 over a control line 46. To initiate a frost build operation, temperature controller 28 sends a signal to driver 30 over control line 46 to cause driver 30 to connect control arm 58 with frost build contact 52. Similarly, to initiate a defrost operation, temperature controller 28 sends a signal to driver 30 over control line 46 to cause driver 30 to connect control arm 58 with defrost contact 54.

In the absence of any signals from defrost recycle apparatus 10 indicating that a defrost operation terminated prematurely, temperature controller 28 determines when to initiate a frost build operation and when to initiate a defrost operation by a default defrost control strategy (such as the defrost control strategy disclosed in Allard). Temperature controller 28 may generally contain components analogous to the adder, latch, counter, and clock (elements 30, 19, 16, and 22, respectively) shown in FIG. 1 of U.S. Pat. No. 4,251,988 issued to Allard et. al. Temperature controller 28 preferably controls the duration of each frost build operation based upon the duration of each previous defrost operation.

Specifically, at the end of a frost build operation, temperature controller 28 transmits a signal over control line 46 to driver 30 to cause control arm 58 of defrost control switch 36 to make contact with defrost contact 54, thus initiating a defrost operation. Defrost heater 34 is thus powered through defrost control switch 36 and through bi-metal switch 44. Temperature controller 28 includes a timer (not shown in FIG. 1) which measures the time that elapses from the beginning of the defrost operation to the time that bi-metal switch 44 opens to terminate the defrost operation.

Bi-metal switch 44 remains closed while the temperature in the vicinity of bi-metal switch 44 is less than the opening temperature. When bi-metal switch 44 opens, the voltage across defrost heater 34 drops. This voltage drop is sensed by temperature controller 28 over a line 50, and designates the termination of the defrost operation.

The value of the elapsed time measured by the timer of temperature controller 28 at the end of the defrost operation is used to determine adjustments to the frost build time of the subsequent frost build operation.

Upon the termination of the defrost operation, temperature controller 28 sends a signal over control line 46 to driver 30 to cause driver 30 to move control arm 58 of defrost control switch 36 into contact with frost build contact 52 to initiate a frost build operation. Thermostat 42 is initially closed during frost build, causing compressor 32 to be energized. Thermostat 42 opens when the temperature in the vicinity of thermostat 42 falls below a temperature setpoint. The temperature setpoint is set by the user of temperature control system 12 and represents the temperature which temperature control system 12 is employed to maintain.

The frost build operation continues until the frost build period expires or until the frost build operation is otherwise aborted. As mentioned above, temperature controller 28 determines the frost build period based upon the previous frost build period as adjusted in response to the duration of the previous defrost operation. During each frost build operation, the temperature controller 28 monitors the voltage across the compressor 32 by a line 48 to determine if compressor 32 is energized continuously for longer than a predetermined maximum duty time. If compressor 32 runs continuously for longer than the maximum duty time, then the current frost build operation is aborted. When the defrost operation is thus aborted, or when the frost build period expires, temperature controller 28 causes driver 30 to connect control arm 58 with defrost contact 54 to again initiate a defrost operation. The cycle thus defined continues unless interrupted by a force defrost signal from defrost recycle apparatus 10, which will now be described in greater detail.

Defrost recycle apparatus 10 includes a defrost recycle controller 14, a sensor 16, a timer 18, and a defrost termination sensor or detector 20. Defrost termination detector 20 is connected to one side of defrost heater 34 by a line 62 and to the other side of defrost heater 34 by a line 66. Thus configured, defrost termination detector 20 senses the voltage across defrost heater 34 to detect the initiation and termination of defrost operations.

Timer 18 is connected to defrost termination detector 20 by a line 26. When a defrost operation terminates, defrost termination detector 20 generates a signal over line 26 to notify timer 18 that a defrost operation has terminated. In response to the signal from defrost termination detector 20, timer 18 begins to measure elapsed time since the termination of the defrost operation.

It has been discovered that upon the termination of a successful defrost operation (one in which heat transfer unit 35 is completely defrosted), the temperature in the vicinity of heat transfer unit 35 decreases at a known rate. Consequently, given the temperature in the vicinity of heat transfer unit 35 at the end of a defrost operation, one is able to predict what the temperature will be after a predetermined period of time has elapsed if the defrost operation was successful. If the temperature after the predetermined time period is below that predicted temperature, then heat transfer unit 35 was probably not free of frost at the termination of the previous defrost operation.

Likewise, given the temperature in the vicinity of heat transfer unit 35 at the end of a defrost operation, one is able to predict the time it will take for the temperature in the vicinity of heat transfer unit 35 to reach a predetermined temperature if the defrost operation was successful. If the time it takes for the temperature in the vicinity of heat transfer unit 35 to reach the predetermined temperature is shorter than the predicted time, then heat transfer unit 35 was probably not free of frost at the termination of the previous defrost operation.

As described above, bi-metal switch 44 opens to terminate a defrost operation when the temperature within the vicinity of heat transfer unit 35 exceeds an opening temperature. Similarly, bi-metal switch 44 recloses as the temperature in the vicinity of heat transfer unit 35 decreases during a frost build operation. Because the temperature in the vicinity of heat transfer unit 35 at the end of a defrost operation is known (the opening temperature), and the temperature change characteristics of heat transfer unit 35 after a successful defrost operation are also known, the time it takes for bi-metal switch 44 to reclose after a successful defrost operation may be accurately predicted. If bi-metal switch 44 recloses before the predicted time, it may be concluded that the defrost operation was not successful because the temperature in the vicinity of heat transfer unit 35 would not have fallen sufficiently to cause bi-metal switch 44 to reclose before the predicted time unless heat transfer unit 35 still contained frost at the end of the previous defrost operation.

To detect the reclosure of bi-metal switch 44, sensor 16 is connected to one side of bi-metal switch 44 by line 62 and to the other side of bi-metal switch 44 by a line 64. Bi-metal switch 44 is connected on one side to power line 38 through defrost heater 34, and is connected on the other side to power line 40 via a line 68 through a high impedance pull-up resistor 70. Pull-up resistor 70 provides a voltage across bi-metal switch 44 when bi-metal switch 44 is open during frost build operations. Sensor 16 is thus configured to detect the voltage across bi-metal switch 44 while bi-metal switch 44 remains open, and to detect a drop in the voltage across bi-metal switch 44 when bi-metal switch 44 recloses. Sensor 16, bi-metal switch 44, and pull-up resistor 70 thus constitute a temperature sensor, configured to detect when the temperature in the vicinity of heat transfer unit 35 causes bi-metal switch 44 to reclose.

Defrost recycle controller 14 includes two comparators 72, 74 which are connected to each other by a line 75. Comparator 72 is connected to sensor 16 over a line 22, and comparator 74 is connected to timer 18 over a line 24. Comparator 72 compares a temperature indication generated by sensor 16 to a predetermined temperature indication, and comparator 74 compares an elapsed time value with the elapsed time measured by timer 18.

Defrost recycle controller 14 is connected to temperature controller 28 by a line 60. Defrost recycle controller 14 transmits a force defrost signal via line 60 when the comparisons made by comparators 72, 74 indicate that a defrost operation has terminated prematurely.

Specifically, upon the termination of a defrost operation, as detected by defrost termination detector 20, timer 18 begins to measure elapsed time from the termination, and comparator 74 begins to compare the elapsed time value measured by timer 18 to a predetermined time value. The predetermined time value represents a time period shorter than the time it takes for bi-metal switch 44 to reclose after the termination of a successful defrost operation.

When the elapsed time measured by timer 18 substantially equals the predetermined time value, comparator 72 compares the temperature indication of sensor 16 with a predetermined temperature indication (i.e., determines whether bi-metal switch 44 has reclosed). If bi-metal switch 44 has reclosed, then the defrost operation is determined to have terminated prematurely, and defrost recycle controller 14 transmits a force defrost signal over line 60 to temperature controller 28.

In response to a force defrost signal, temperature controller 28 aborts the current frost build operation and initiates a defrost operation. A recycle operation initiated in response to a force defrost signal is referred to herein as a recycle defrost operation.

In an alternate embodiment, defrost recycle controller 14 waits until comparator 72 indicates that bi-metal switch 44 has reclosed. Comparator 74 then compares the time that has elapsed since the termination of the last defrost operation, as measured by timer 18, with a value indicative of the time it would take bi-metal switch 44 to close after a successful defrost operation. If the comparison indicates that bi-metal switch 44 closed before it would have after a successful defrost operation, defrost recycle controller 14 transmits a force defrost signal to temperature controller 28 to initiate a recycle defrost operation.

After a recycle defrost operation, heat transfer unit 35 is presumed to be free of frost, so it is not desirable to allow consecutive recycle defrost operations. Therefore, defrost recycle controller 14 includes a recycle flag 80 for indicating whether the previous defrost operation was a recycle defrost operation. If the previous defrost operation was a recycle defrost operation, then defrost recycle controller 14 does not transmit a force defrost signal, regardless of the comparisons made by comparators 72, 74. The operation of defrost recycle apparatus 10 will be described in greater detail below with reference to FIGS. 3 and 4.

Figure 2:
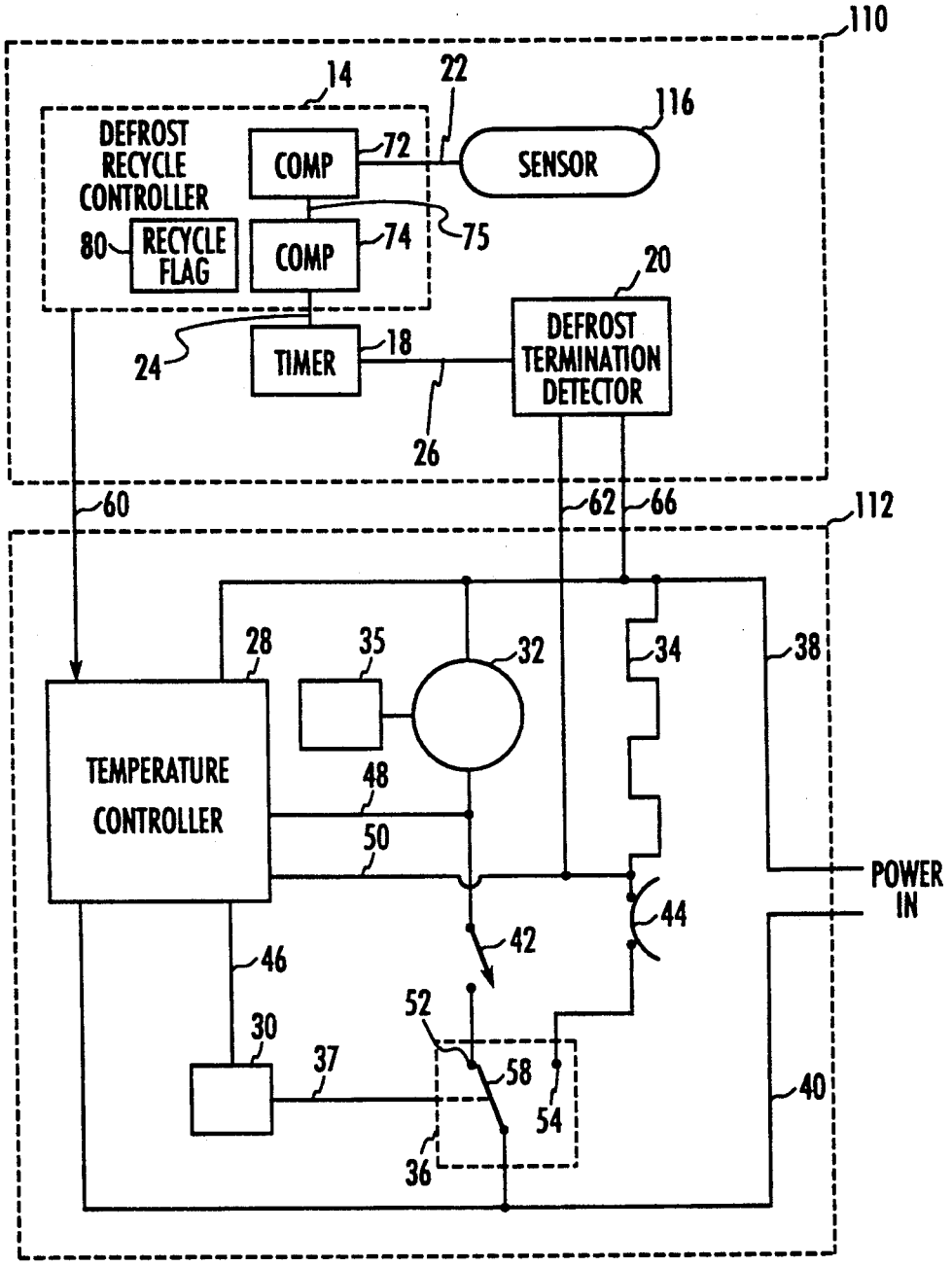
FIG. 2 is a block diagram of a defrost recycle device, according to an alternate embodiment of the invention, operatively connected with a temperature control system.

FIG. 2 is a block diagram of a defrost recycle device 110 according to an alternate embodiment of the invention, operatively connected with a temperature control system 112. Temperature control system 112 is similar to temperature control system 12 (FIG. 1). Temperature control system 112 differs from temperature control system 12 in that temperature control system 112 does not include a high impedance pull-up resistor analogous to high impedance pull-up resistor 70 of temperature control system 12.

Defrost recycle apparatus 110 differs from defrost recycle apparatus 10 in that sensor 16 has been replaced in defrost recycle apparatus 110 by a sensor 116. While sensor 16 was configured to measure temperature as indicated by the reclosure of bi-metal switch 44, sensor 116 is configured to measure a parameter associated with the termination of the defrost operation by other means. For example, sensor 116 may be a conventional temperature sensor located in the vicinity of heat transfer unit 35 for measuring the temperature of heat transfer unit 35.

As discussed above, the temperature within the vicinity of heat transfer unit 35 is affected by the amount of frost accumulation on heat transfer unit 35. Therefore, the frost accumulation on heat transfer unit 35 at the termination of a defrost operation may be predicted by how long the temperature within the vicinity of heat transfer unit 35 takes to reach a predetermined temperature after the termination of the defrost operation.

Similarly, the pressure within heat transfer unit 35 is also affected by the amount of frost accumulation on heat transfer unit 35. Therefore, sensor 116 may alternatively be a pressure sensor configured to measure the pressure within heat transfer unit 35. When sensor 116 is a pressure sensor, the frost accumulation on heat transfer unit 35 at the termination of a defrost operation may be predicted by how long the pressure within heat transfer unit 35 takes to reach a predetermined pressure after the defrost operation. Conversely, the frost accumulation on heat transfer unit 35 at the termination of a defrost operation may also be predicted based upon the actual pressure within heat transfer unit 35 after a predetermined period of time has elapsed from the termination of the defrost operation.

Figure 3:
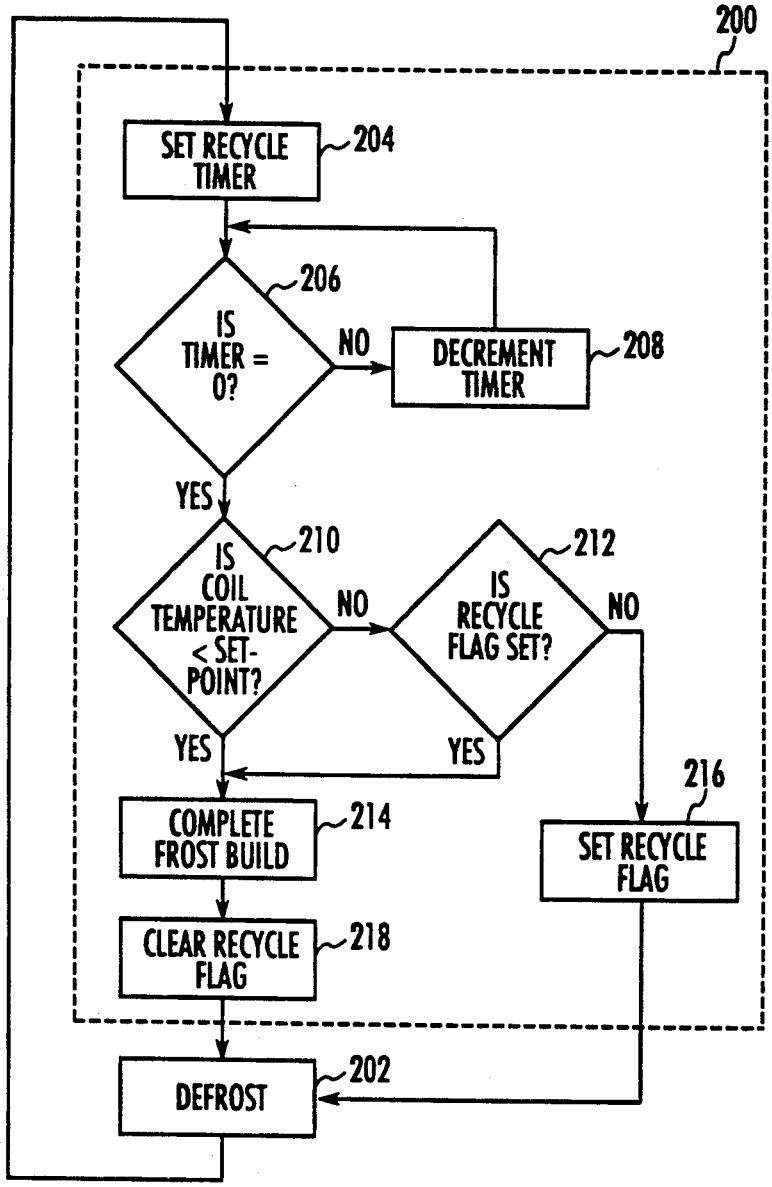
FIG. 3 is a control flow diagram illustrating the operation of a defrost recycle device according to one embodiment of the invention.

FIG. 3 is a control flow diagram illustrating the operation of a defrost recycle device according to one embodiment of the invention. In FIG. 3, box 200 generally represents a frost build operation and box 202 represents a defrost operation.

At the beginning of a frost build operation, in step 204, timer 18 (FIG. 1, 2) is initialized and begins to measure elapsed time. The elapsed time value measured by timer 18 is compared to a predetermined value by comparator 74 in step 206. If the elapsed time value substantially equals the predetermined value, control passes to step 210, otherwise control passes to step 208. In step 208, timer 18 decrements the elapsed time value, and control passes again to step 206. The cycle defined by steps 206, 208 continues until the elapsed time value measured by timer 18 substantially equals the predetermined value. While timer 18 has been described as a decrementing timer configured to count down for a predetermined time period, timer 18 may alternatively be an incrementing timer configured to count up for the predetermined time period.

When the elapsed time value of timer 18 reaches the predetermined time in step 206, control passes to step 210. In step 210, the temperature in the vicinity of heat transfer unit 35, as measured by sensor 16, 116, is compared to a predetermined temperature indication or setpoint in comparator 72.

The temperature setpoint represents the temperature that heat transfer unit 35 would be at after the predetermined period of elapsed time if the previous defrost operation was successful. Thus, if the actual temperature is not below the temperature setpoint, control passes to step 214 where the current frost build operation is allowed to complete normally. Otherwise, control passes to step 212.

In step 212, defrost recycle controller 14 determines if the recycle flag 80 is set. Recycle flag 80 is considered "set" when recycle flag 80 is at a predetermined state, such as, for example, a logical HIGH. Recycle flag 80 is considered "cleared" or "not set" when recycle flag 80 is not at the predetermined state. A set recycle flag 80 indicates that the previous defrost operation was a recycle defrost operation. Therefore, if it is determined in step 212 that recycle flag 80 was set, control passes to step 214 and the current frost operation is allowed to complete normally.

On the other hand, if recycle flag 80 is not set, control passes to step 216, where recycle flag 80 is set, and then control passes to step 202 to abort the current frost build operation and initiate a recycle defrost operation.

If the current frost build operation is allowed to complete normally, at step 214, recycle flag 80 is cleared in step 218 to indicate that the subsequent defrost operation is not a recycle defrost operation.

Figure 4:
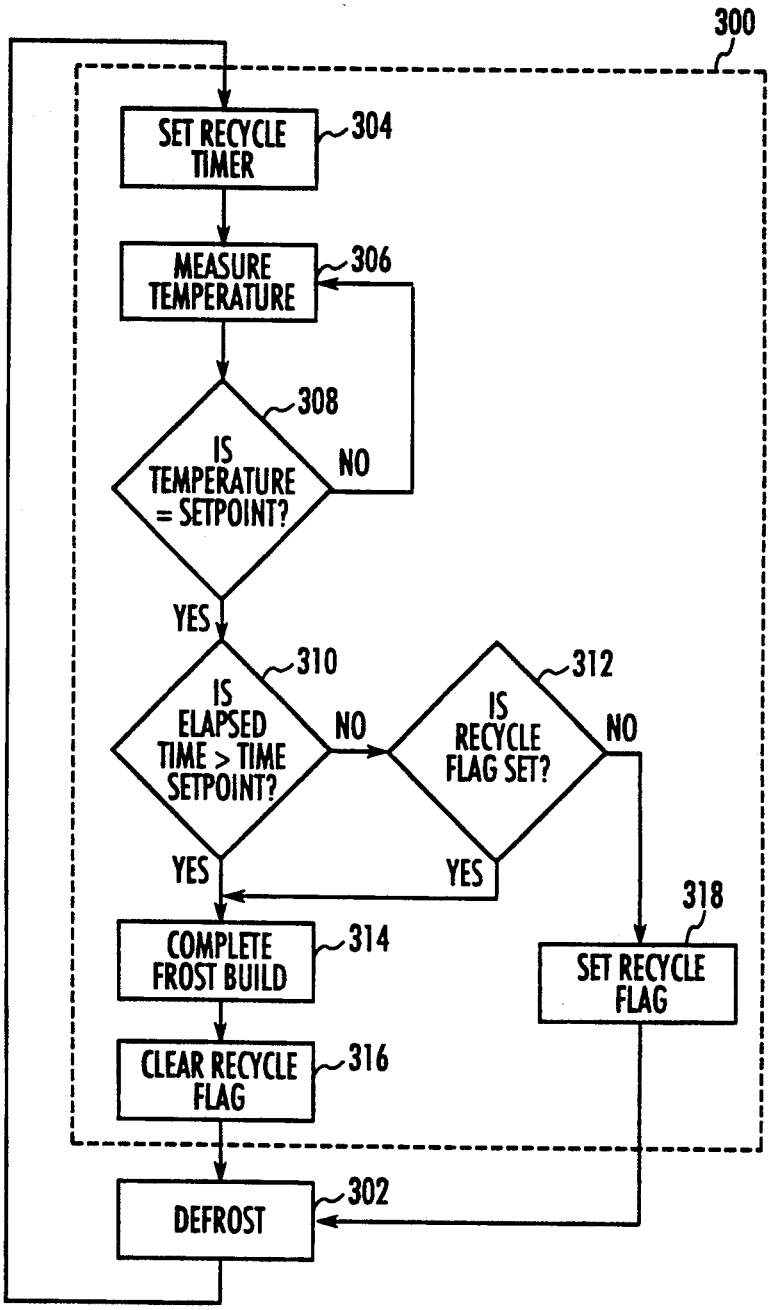
FIG. 4 is a control flow diagram illustrating the operation of a defrost recycle device according to an alternate embodiment of the invention.

FIG. 4 is a control flow diagram illustrating the operation of a defrost recycle device according to an alternate embodiment of the invention. In FIG. 4, box 300 generally represents a frost build operation and box 302 represents a defrost operation.

In step 304, timer 18 begins to measure elapsed time from the termination of the previous defrost operation. In step 306, the temperature in the vicinity of heat transfer unit 35 is measured by sensor 16, 116. In step 308 the measured temperature is compared to a predetermined temperature setpoint. If the measured temperature does not substantially equal the predetermined temperature setpoint, then control passes back to step 306. The cycle defined by steps 306, 308 continues until the measured temperature substantially equals the temperature setpoint. When the measured temperature substantially equals the temperature setpoint, control passes to step 310.

In step 310, the elapsed time measured by timer 18 is compared in comparator 74 to a time setpoint. The time setpoint represents the time it would take for the temperature setpoint to be reached if the previous defrost cycle was successful. If the actual elapsed time is less than the time setpoint, the previous defrost cycle is considered to have terminated prematurely and control passes to step 312.

If it is determined in step 310 that the previous defrost cycle did not terminate prematurely, then control passes to step 314 and the current frost build operation is allowed to complete normally, according to the default defrost control strategy. After the normal completion of the frost build cycle, recycle flag 80 is cleared in step 316, and a normal defrost cycle is initiated in step 302.

On the other hand, if it is determined in step 310 that the previous defrost operation terminated prematurely, the defrost recycle controller 14 determines if recycle flag 80 is set. If recycle flag 80 is set, control passes to step 314 and the current frost build cycle is allowed to terminate normally as described above. If, in step 312, it is determined that recycle flag 80 is not set, then recycle flag 80 is set in step 318, the current frost build operation is aborted, and a recycle defrost operation is initiated in step 302.

While FIGS. 3 and 4 describe the operation of embodiments of the invention implemented to measure time and temperature, the invention may alternatively be implemented to measure time and pressure, as discussed above. Further, the temperature control system and defrost recycle devices disclosed herein have been presented as discrete systems having discrete components, but they may alternatively be combined into a single system, which may be based on analog or digital logic, or a combination of both. For example, defrost recycle controller 14, timer 18, and temperature controller 28 may be implemented in a single programmed microprocessor. Various other substitutions, modifications, changes and omissions may be made in the design and arrangement of the elements without departing from the spirit of the invention.

Therefore, it is to be understood that, while the detailed drawings and specific examples given describe preferred embodiments of the invention, they are for the purpose of illustration, that the apparatus of the invention is not limited to the precise details and conditions disclosed and that various changes may be made therein without departing from the spirit of the invention which is defined by the following claims:

What is claimed is:

1. An apparatus for use with a defrost control device for indicating an occurrence of a premature termination of a defrost operation, said defrost control device generating a termination indication when said defrost operation terminates, the apparatus comprising:

a sensing means operatively connected with said defrost control device for sensing said termination indication;

a first measuring means for measuring one of a first or a second parameter associated with said defrost operation as a first measured parameter;

a second measuring means for measuring the other of said first or second parameters associated with said defrost operation as a second measured parameter;

said first measuring means, said second measuring means, and said sensing means being operatively connected; said second measuring means generating a measured second parameter value indicating said second measured parameter as measured substantially when said first measured parameter substantially equals a first predetermined value;

a comparing means operatively connected with said second measuring means for comparing said measured second parameter value with a second predetermined value; and a signal generating means operatively connected with said comparing means for generating a premature termination signal when said measured second parameter value has a particular relationship with said second predetermined value.

2. An apparatus for use with a defrost control device for indicating an occurrence of a premature termination of a defrost operation as recited in claim 1 wherein said first measuring means includes a temperature sensor, said first measured parameter being temperature, and said first predetermined value being a predetermined temperature.

3. An apparatus for use with a defrost control device for indicating an occurrence of a premature termination of a defrost operation as recited in claim 2 wherein said defrost control device includes a heat transfer unit, said temperature sensor being configured to measure a heat transfer unit temperature within a predetermined distance of said heat transfer unit.

4. An apparatus for use with a defrost control device for indicating an occurrence of a premature termination of a defrost operation as recited in claim 3 wherein said second measuring means includes a timer, said second measured parameter being time elapsed since said termination indication, and said second predetermined value being a predetermined period of time.

5. An apparatus for use with a defrost control device for indicating an occurrence of a premature termination of a defrost operation as recited in claim 4 wherein said second measuring means is operatively connected with said temperature sensor.

6. An apparatus for use with a defrost control device for indicating an occurrence of a premature termination of a defrost operation as recited in claim 3 wherein said temperature sensor includes a bi-metal switch positioned within said predetermined distance of said heat transfer unit.

7. An apparatus for use with a defrost control device for indicating an occurrence of a premature termination of a defrost operation as recited in claim 6 wherein said bi-metal switch is configured to close when said heat transfer unit temperature substantially equals said predetermined temperature.

8. An apparatus for use with a defrost control device for indicating an occurrence of a premature termination of a defrost operation as recited in claim 1 wherein said first measuring means includes a pressure sensor, said first measured parameter being pressure, and said first predetermined value being a predetermined pressure.

9. An apparatus for use with a defrost control device for indicating an occurrence of a premature termination of a defrost operation as recited in claim 8 wherein said defrost control device includes a heat transfer unit, said pressure sensor being configured to measure pressure within said heat transfer unit.

10. An apparatus for use with a defrost control device for indicating an occurrence of a premature termination of a defrost operation as recited in claim 9 wherein said second measuring means includes a timer, said second measured parameter being time elapsed since said termination indication, and said second predetermined value being a predetermined period of time.

11. An apparatus for use with a defrost control device for indicating an occurrence of a premature termination of a defrost operation as recited in claim 10 wherein said second measuring means is operatively connected with said pressure sensor.

12. An apparatus for use with a defrost control device for indicating an occurrence of a premature termination of a defrost operation as recited in claim 1 wherein said first measuring means includes a timer, said first measured parameter being time elapsed since said termination indication, and said first predetermined value being a predetermined period of time.

13. An apparatus for use with a defrost control device for indicating an occurrence of a premature termination of a defrost operation as recited in claim 12 wherein said second measuring means includes a temperature sensor, said second measured parameter indicating temperature, and said second predetermined value being a predetermined temperature indication.

14. An apparatus for use with a defrost control device for indicating an occurrence of a premature termination of a defrost operation as recited in claim 13 wherein said defrost control device includes a heat transfer unit, said temperature sensor being configured to generate a measured temperature indication in response to temperature within a predetermined distance of said heat transfer unit.

15. An apparatus for use with a defrost control device for indicating an occurrence of a premature termination of a defrost operation as recited in claim 14 wherein said second measuring means is operatively connected with said timer.

16. An apparatus for use with a defrost control device for indicating an occurrence of a premature termination of a defrost operation as recited in claim 14 wherein said temperature sensor includes a bi-metal switch positioned within said predetermined distance of said heat transfer unit, said measured temperature indication indicating whether said bi-metal switch is closed.

17. An apparatus for use with a defrost control device for indicating an occurrence of a premature termination of a defrost operation as recited in claim 16 wherein said bi-metal switch is configured to close when said heat transfer unit temperature substantially equals a predetermined temperature.

18. An apparatus for use with a defrost control device for indicating an occurrence of a premature termination of a defrost operation as recited in claim 12 wherein said second measuring means includes a pressure sensor, said second measured parameter indicating pressure, and said second predetermined value being a predetermined pressure indication.

19. An apparatus for use with a defrost control device for indicating an occurrence of a premature termination of a defrost operation as recited in claim 18 wherein said defrost control device includes a heat transfer unit, said pressure sensor being configured to generate a measured pressure indication in response to pressure within said heat transfer unit.

20. An apparatus for use with a defrost control device for indicating an occurrence of a premature termination of a defrost operation as recited in claim 19 wherein said second measuring means is operatively connected with said timer.

21. An apparatus for use with a temperature control device for indicating an occurrence of a premature termination of a defrost operation, said temperature control device being configured to control temperature within an enclosed space, said temperature control device generating a termination indication when said defrost operation terminates, the apparatus comprising:

a sensing means operatively connected with said temperature control device for sensing said termination indication;

a monitoring means operatively connected with said sensing means for monitoring a parameter associated with a condition within said enclosed space as a first measured parameter, and for monitoring elapsed time from said termination indication as a second measured parameter;

a first comparing means operatively connected with said monitoring means for comparing a selected parameter of said first measured parameter or said second measured parameter with a first predetermined value;

a second comparing means operatively connected with said first comparing means and said monitoring means, for comparing the other parameter of said first measured parameter or said second measured parameter than said selected parameter with a second predetermined value when said selected parameter substantially equals said first predetermined value; and a signal generating means operatively connected with said second comparing means for generating a premature termination signal when said other parameter has a particular relationship with said second predetermined value.

22. A method for indicating an occurrence of a premature termination of a defrost operation, said defrost operation being performed by a defrost control device, said defrost control device generating a termination indication when said defrost operation terminates, the method comprising the steps of:

sensing said termination indication;

measuring one of a first parameter and a second parameter associated with said defrost operation as a first measured parameter;

measuring the other of said first parameter and said second parameter than said first measured parameter as a second measured parameter;

generating a second measured parameter value indicating said second measured parameter as measured substantially when said first measured parameter substantially equals a first predetermined value;

comparing said second measured parameter value with a second predetermined value; and generating a premature termination signal when said second measured parameter value has a particular relationship with said second predetermined value.

23. A method for indicating an occurrence of a premature termination of a defrost operation as recited in claim 22 further comprising the step of setting a recycle flag when, after said comparing said second measured parameter value with said second predetermined value, said second measured parameter value has said particular relationship with said second predetermined value.

24. A method for indicating an occurrence of a premature termination of a defrost operation as recited in claim 23 further comprising the step of clearing said recycle flag when, after said comparing said second measured parameter value with said second predetermined value, said second measured parameter value does not have said particular relationship with said second predetermined value.

25. A method for indicating an occurrence of a premature termination of a defrost operation as recited in claim 24 wherein said generating said premature termination signal is not performed when said recycle flag is set.

26. A method for indicating an occurrence of a premature termination of a defrost operation as recited in claim 22 wherein said first measured parameter is temperature and said first predetermined value is a predetermined temperature.

27. A method for indicating an occurrence of a premature termination of a defrost operation as recited in claim 26 wherein said defrost control device includes a heat transfer unit, said step of measuring said first measured parameter including measuring a heat transfer unit temperature within a predetermined distance of said heat transfer unit.

28. A method for indicating an occurrence of a premature termination of a defrost operation as recited in claim 27 wherein said second measured parameter is time elapsed since said termination indication, and said second predetermined value is a predetermined period of time.

29. A method for indicating an occurrence of a premature termination of a defrost operation as recited in claim 27 wherein a bi-metal switch is positioned within said predetermined distance of said heat transfer unit, said step of measuring said first measured parameter including determining whether said bi-metal switch is closed.

30. A method for indicating an occurrence of a premature termination of a defrost operation as recited in claim 22 wherein said first measured parameter is pressure, and said first predetermined value is a predetermined pressure.

31. A method for indicating an occurrence of a premature termination of a defrost operation as recited in claim 30 wherein said defrost control device includes a heat transfer unit, said step of measuring said first measured parameter including measuring pressure within said heat transfer unit.

32. A method for indicating an occurrence of a premature termination of a defrost operation as recited in claim 31 wherein said second measured parameter is time elapsed since said termination indication, and said second predetermined value is a predetermined period of time.

33. A method for indicating an occurrence of a premature termination of a defrost operation as recited in claim 22 wherein said first measured parameter is time elapsed since said termination indication, and said first predetermined value is a predetermined period of time.

34. A method for indicating an occurrence of a premature termination of a defrost operation as recited in claim 33 wherein said second measured parameter indicates temperature, and said second predetermined value is a predetermined temperature indication.

35. A method for indicating an occurrence of a premature termination of a defrost operation as recited in claim 34 wherein said defrost control device includes a heat transfer unit, said step of measuring said second measured parameter including measuring a measured temperature indication representative of temperature within a predetermined distance of said heat transfer unit.

36. A method for indicating an occurrence of a premature termination of a defrost operation as recited in claim 35 wherein a bi-metal switch is positioned within said predetermined distance of said heat transfer unit, said step of measuring said second measured parameter including determining whether said bi-metal switch is closed.

37. A method for indicating an occurrence of a premature termination of a defrost operation as recited in claim 33 wherein said second measured parameter indicates pressure, and said second predetermined value is a predetermined pressure indication.

38. A method for indicating an occurrence of a premature termination of a defrost operation as recited in claim 37 wherein said defrost control device includes a heat transfer unit, said step of measuring a second measured parameter including measuring a measured pressure indication representative of pressure within said heat transfer unit.

* * * * *